United States Patent [19]

Van Den Braak

[11] Patent Number: 5,040,584

[45] Date of Patent: Aug. 20, 1991

[54] SLAT DEVICE

[76] Inventor: Peter Van Den Braak, Het Bosch 13, 6681 DG Bemmel, Netherlands

[21] Appl. No.: 207,046

[22] PCT Filed: Sep. 25, 1987

[86] PCT No.: PCT/NL87/00023

§ 371 Date: Jun. 24, 1988

§ 102(e) Date: Jun. 24, 1988

[87] PCT Pub. No.: WO88/02431

PCT Pub. Date: Apr. 7, 1988

[30] Foreign Application Priority Data

Sep. 26, 1986 [NL] Netherlands ..... 8602443

[51] Int. Cl.[5] ..... E06B 9/30

[52] U.S. Cl. ..... 160/168.1

[58] Field of Search ..... 160/168.1, 176.1, 900, 160/201, 178.1

[56] References Cited

U.S. PATENT DOCUMENTS

| | | | |
|---|---|---|---|
| 3,280,891 | 10/1966 | Eldredge, Jr. et al. | 160/176.1 X |
| 4,102,381 | 7/1978 | Bratschi | 160/176.1 X |
| 4,122,884 | 10/1978 | Salzmann | 160/176.1 X |

FOREIGN PATENT DOCUMENTS

| | | | |
|---|---|---|---|
| 1143933 | 10/1957 | France | 160/900 |

*Primary Examiner*—Blair M. Johnson

*Attorney, Agent, or Firm*—Harness, Dickey & Pierce

[57] ABSTRACT

Slat device comprising a number of slat elements disposed next to each other on a supporting structure and at least one adjusting mechanism for adjusting the angular position of the slat elements, said adjusting mechanism comprises a pin-hole combination in which the pin and the hole are provided with means to be brought into and out of engagement and in which the pin is disposed in the slat element or the supporting structure respectively and the hole is disposed in the supporting structure or the slat element respectively.

12 Claims, 7 Drawing Sheets

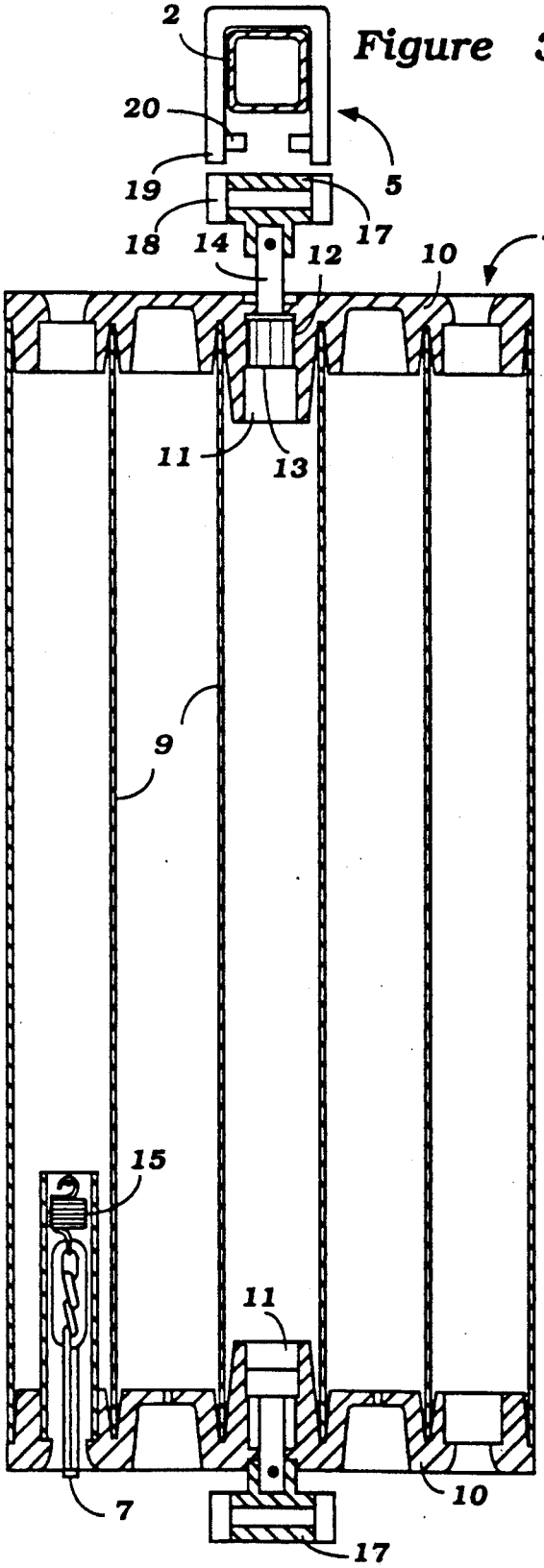
Figure 3
Figure 4
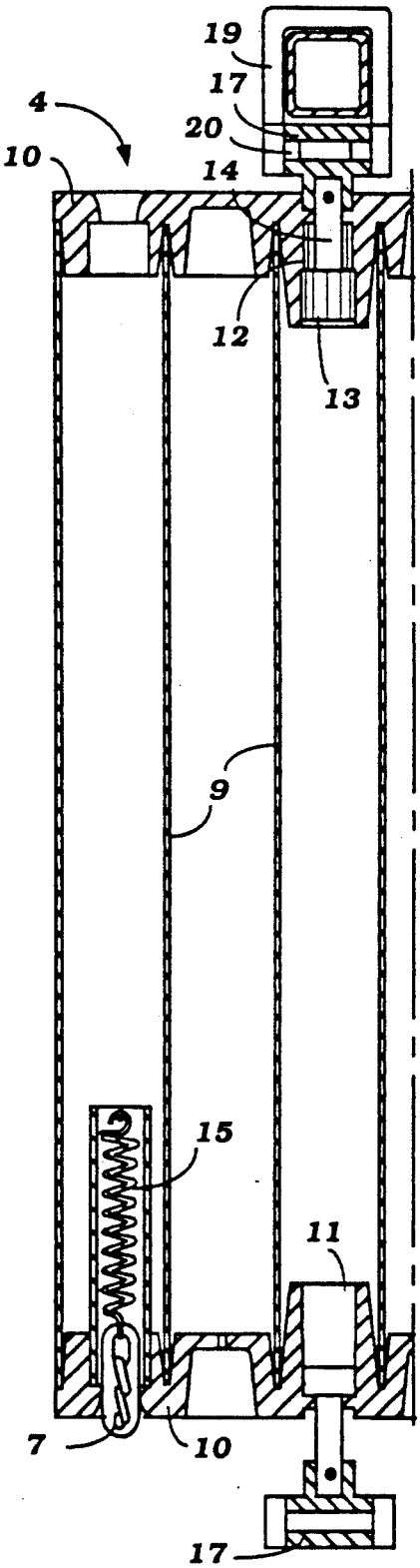

SLAT DEVICE

The present invention relates to a slat device comprising slat elements disposed next to each other on a supporting structure and at least one adjusting mechansim for adjusting the angular position of the slat elements.

Such a slat device is known from NL-A-7,200,563 and comprises a complicated gearwheel system for fixing the slat elements in a particular angular position.

It is the object of the present invention to provide a slat device in which the simple fixing of the angular position is provided.

This is achieved in a slat device described above in that the adjusting mechanism comprises a pinhole combination in which the pin and the hole are provided with means to be brought into and out of engagement and in which the pin is disposed in the slat element or the supporting structure respectively and the hole is disposed in the supporting structure or the slat element respectively. In this manner, by simply moving the pin and the hole with respect to each other, the fastening of the slat element can be eliminated and restored again after the readjustment.

According to an embodiment which is of advantage, the means to be brought into engagement are constructed in a manner such that, when the pin is moved in the direction outwards from the hole, the engagement is eliminated. This means that the means for bringing into engagement are situated near the bottom of the hole. Said means may comprise teeth both in the hole and on the pin which have a corresponding shape.

At the same time it is not necessary for such a pinhole connection to be situated at both ends of a slat and, in addition, it is not necessary for such an adjusting device to be fitted in the case of each slat element if a row of slat elements is used. In the last case it is sufficient that the slat elements not provided with an adjusting mechanism are connected by connecting means to the slat element which is provided with the adjusting mechanism. In addition, the slat elements may be displaceably fitted on the supporting structure so that the vertical slat device can be telescoped and a harmonica-like wall obtained. In this case, the connecting means may comprise cords which are fitted near the corresponding ends of the slat elements. In order to prevent the possibility that, if the slat elements are completely in line, the cords, which then extend past the points of rotation, which have become thicker, of the slat elements, are stretched too much, the provision is made that they are fitted with limited flexibility in the case of at least one of the slat elements.

The supporting structure may comprise a sliding device for each slat element around a guide rail, the pin or the hole respectively being provided in the sliding device. In a manner which is of advantage, the supporting structure is a profiled component, the sliding device comprising a body embracing said profiled component. As a result of this, the sliding device slides around the supporting structure so that the slat device, which is realised in this manner, can be used out of doors in a manner which is of particular advantage or in places where contamination is to be feared, because jamming is less likely in the case of a slide moving around a structure than in the case in which the slide runs in, for example, a U-shaped duct. According to an embodiment which is of advantage, the pin is provided mounted directly on the sliding device. As a result of this, by lifting up the vertical slat element, the engagement between the pin and the hole can be eliminated and, if the desired new position has been formed, locking can be achieved by simply lowering the slat element.

According to another embodiment which is of advantage, in the case of the pin-hole combination, the pin is constructed as a sleeve provided with teeth which is mounted nonrotatably but displaceably on a suspension pin of the slat element. To preset the sleeve in the locked position, a spring may be present. To operate the sleeve in the case in which the slat element is mounted only rotatably and therefore not displaceably on the supporting structure, a sliding body is used which is provided with a sloping cutout which engages the sleeve so that when said sliding body is displaced, the sleeve is moved in an unlocking manner against the spring force. By moving the sliding element back, the sleeve can be locked again. Drive for said sliding body can take place in all the manners known in the state of the art.

To rotate the slat element or the suspension pin connected to it, it can be provided with a rotating drive known in the prior art. According to a particularly simple embodiment, the drive comprises a pinion gearwheel fitted on the slat body or on the suspension pin and a rack fitted in the supporting structure. If it is not locked, the slat element can then be rotated by moving the rack to and fro. The drive may, however, also comprise a gearwheel train, a gearwheel being connected to the slat element or the suspension pin respectively, while another gearwheel of the gearwheel train is fitted on a spindle rotably mounted on the supporting structure. Finally, the sleeve can be provided with at least one forked leg which can engage the slat element. As a result of this, double protection is provided, on the one hand, by the hole-pin combination and, on the other hand, by the engagement with the forked leg or forked legs of the slat element. In this case, the structure can be such that the forked leg or forked legs can be moved along the slat element only in a preferred position thereof so that complete locking is possible only in one position of the slat device.

The adjusting mechanism described above can be fitted at both ends of a slat element. In that case, the adjusting mechanisms are connected to each other for combined operation.

The invention also relates to a balcony railing comprising a slat device as described above.

The invention will now be explained in more detail on the basis of an exemplary embodiment depicted in the drawing, wherein:

FIG. 1 shows a side view of a vertical slat device according to the invention, FIG. 2 shows diagrammatically a plan view of the device depicted in FIG. 1, FIG. 3 shows a cross-section of a slat element used in FIG. 1 in the locked position, FIG. 4 shows a cross-section according to FIG. 3 in the unlocked condition of the slat element, FIG. 5 shows in cross-section a detail of a possible embodiment of the suspension of the slat element, FIG. 6 shows a longitudinal section of the supporting structure and slat element along line VI—VI in FIG. 8 such as can be used in a railing in the locked position of the slat element, FIG. 7 shows a longitudinal section corresponding to FIG. 6 in the unlocked position of the slat element, along line VII—VII in FIG. 9, FIG. 8 shows a cross-section along line VIII—VIII in FIG. 6, FIG. 9 shows a cross-section along IX—IX in FIG. 7, FIG. 10 shows a section along line X—X in FIG. 8, FIG. 11 shows a section along line XI—XI in FIG. 9, FIG. 12 shows a cross-section of a further embodiment according to FIGS. 6–11 in which the slat element is provided on both ends with an adjusting mechanism, FIG. 13 shows the supporting structure and the slat element used in a protected screen in the unlocked or partially locked position respectively, FIG. 14 shows a cross-section corresponding to FIG. 13 in completely locked position.

Figure 1:
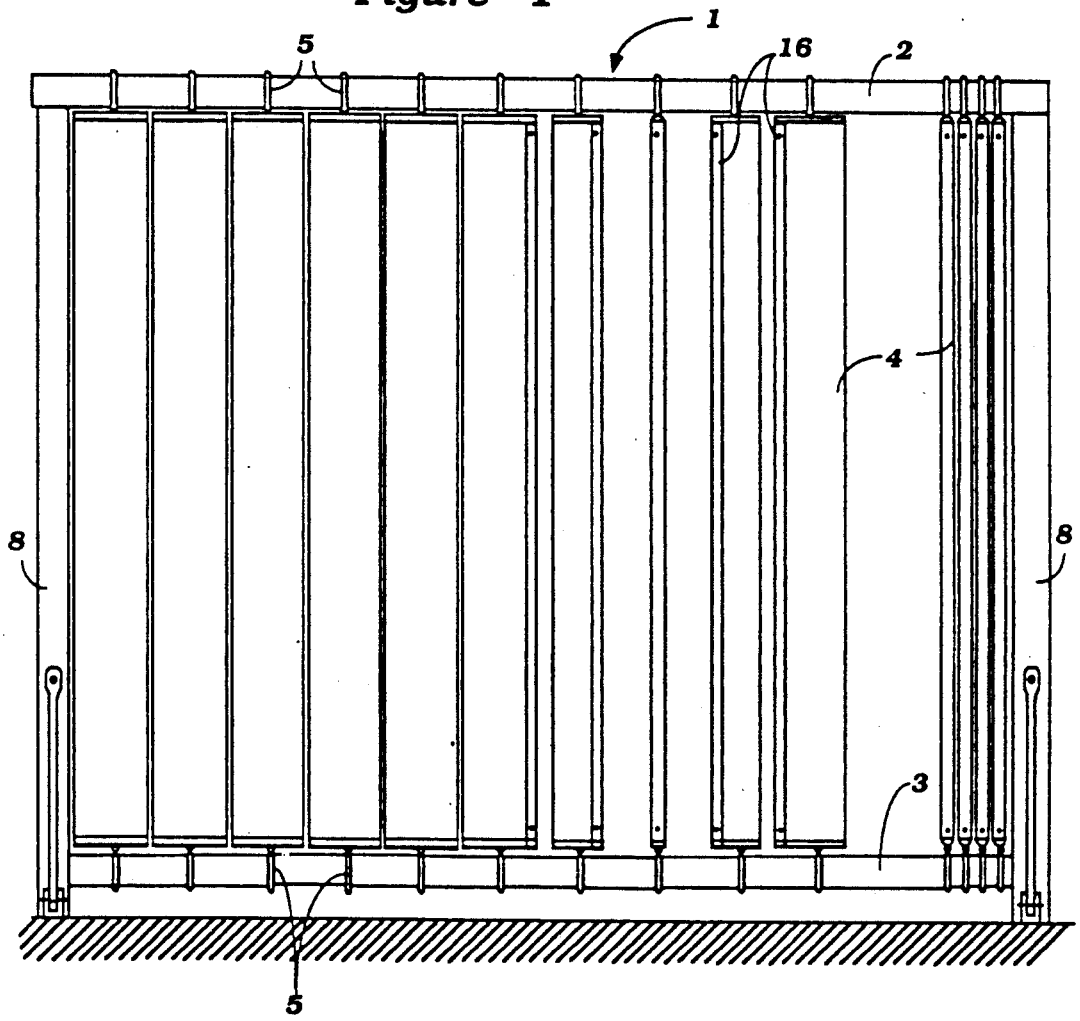
Figure 2:
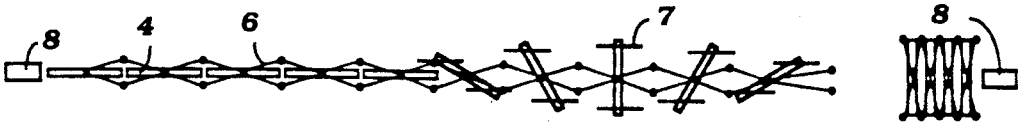

FIGS. 1 and 2 depict a vertical slat device indicated as a whole by 1 which comprises a top guide rail 2 and a bottom guide rail 3. Between the latter are disposed the slat elements 4 which, as is evident from both figures, can be rotated and displaced. Said slat elements 4 are disposed on the guide rails 2, 3 via a sliding structure 5. Said sliding structure comprises a profiled component extending around the guide rail. This has the advantage that in the event of contamination, which cannot always be eliminated in the case of use in the open atmosphere, jamming of the slats does not occur, which jamming presents a considerable hazard if the sliding structure is disposed, for example, in a duct. As depicted in FIG. 2, the slats are connected to each other via a tong structure 6, such as a lazy tong. In order to maintain the mutual angular position, use is made of a cord 7, of which only parts are depicted. The vertical slat device is mounted on a foundation by means of stands 8.

FIGS. 3 and 4 depict the cross-section of one of the slat elements 4 from FIGS. 1 and 2. From these it is evident that each slat element comprises a row of transverse partitions 9, which provide rigidity, connected at the top and bottom by nesting bodies 10. A drilled hole 11 is disposed in the centre of said nesting body 10. In the embodiment depicted, said drilled hole is provided locally at the top only with teeth 12 which are to be engaged in the teeth 13 of a suspension pin 14. In the condition depicted in FIG. 3, this engagement is achieved, while, as a result of pressing the slat element upwards as depicted in FIG. 4, said slat element is freely rotatable with respect to the suspension pin 14. After rotating the slat element 4 in the raised position and then lowering it, the slat element can be locked in a different angular position. Although the teeth are depicted only at the top of the slat element 4, it must be understood that they can equally well be disposed only at the bottom or on both sides of the slat element/nesting body. In order to achieve the result that a number of slats can be locked by only one adjusting mechanism, the cords 7 already described above can be provided, it being possible, by rotating the slat element depicted in FIGS. 3 and 4, to move the other slat elements connected thereto via cords, assuming, of course, that said other slat elements do not have teeth 12, 13. Because the length of the cord 7 has to increase when the slat elements 4 are situated virtually in line because cord 7 no longer extends radially between the respective slat elements as a result of the thickness of the hinge, and to absorb the lengthening of the cord when the slat element 4 is raised, the end of the cord 7 is attached to the slat element via a spring 15 in the case of one or more slat elements, as a result of which a certain flexibility is provided. This is depicted in FIGS. 3 and 4. If a row of slat elements are used of which only one is provided with an adjusting mechanism, the other slat elements may be longer in construction than said one slat element, because space has to be provided in the case of said one slat element for the up and down movement. The slat elements 4 may be provided at the ends with a partial recess indicated in FIG. 1 by 16, as a result of which a smoothly extending entity is obtained when the slat elements are snapped shut against each other. FIG. 3 also shows the dismantled mounting of the slat element 4 via the sliding structure 5. Said sliding structure 5 comprises a pivot block 17, rigidly connected to suspension pin 14, which is provided with two openings 18 and which is mounted in a sliding block 19 by means of the projections 20 engaging in the openings 18.

Figure 5:
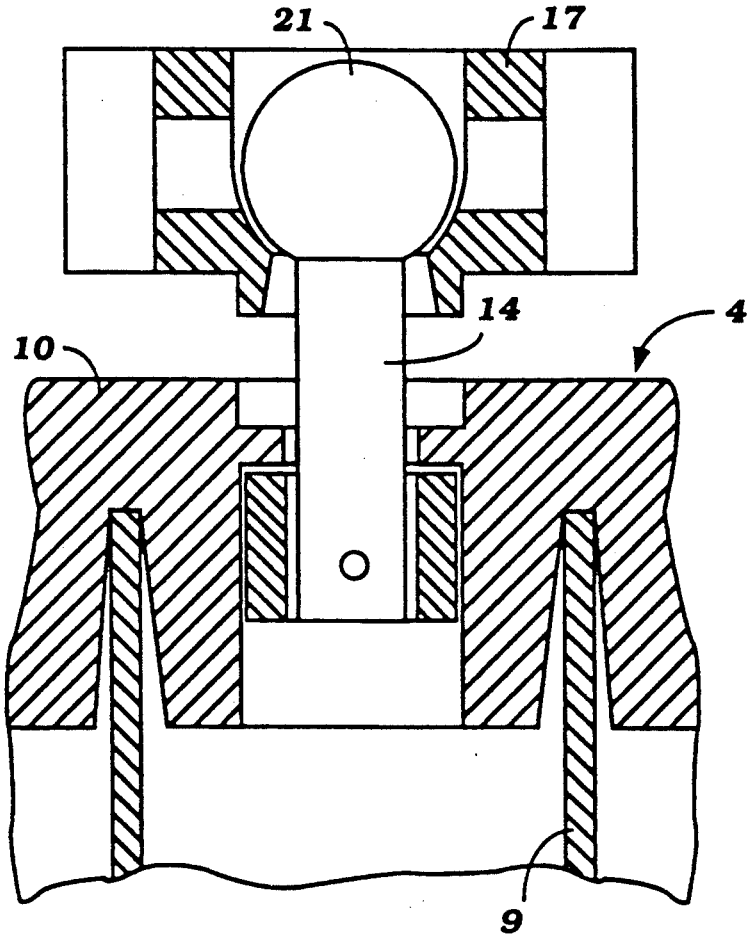

According to the type of guide rail 2 which is used, only the sliding block 19 has to be fitted. FIG. 5 depicts another structure of the pivot block 17. In this case suspension pin 14 is suspended so as to rotate freely on the pivot block 17 via a ball head 21. In this case locking is obviously no longer possible and the structure depicted in FIG. 5 may be used in a manner which is of advantage in the case of those slat elements which are not provided with the adjusting mechanism for adjusting the angular position of the slat elements and which are suspended only at one end.

Figure 6:
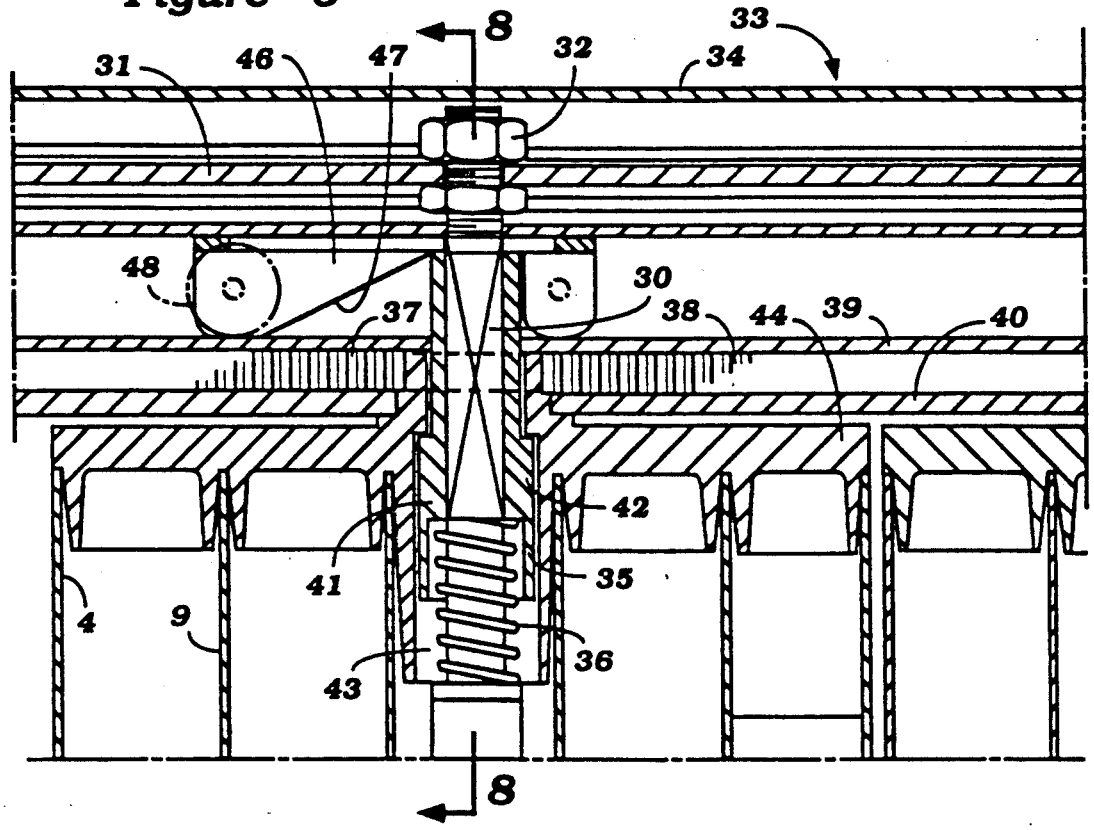
Figure 7:
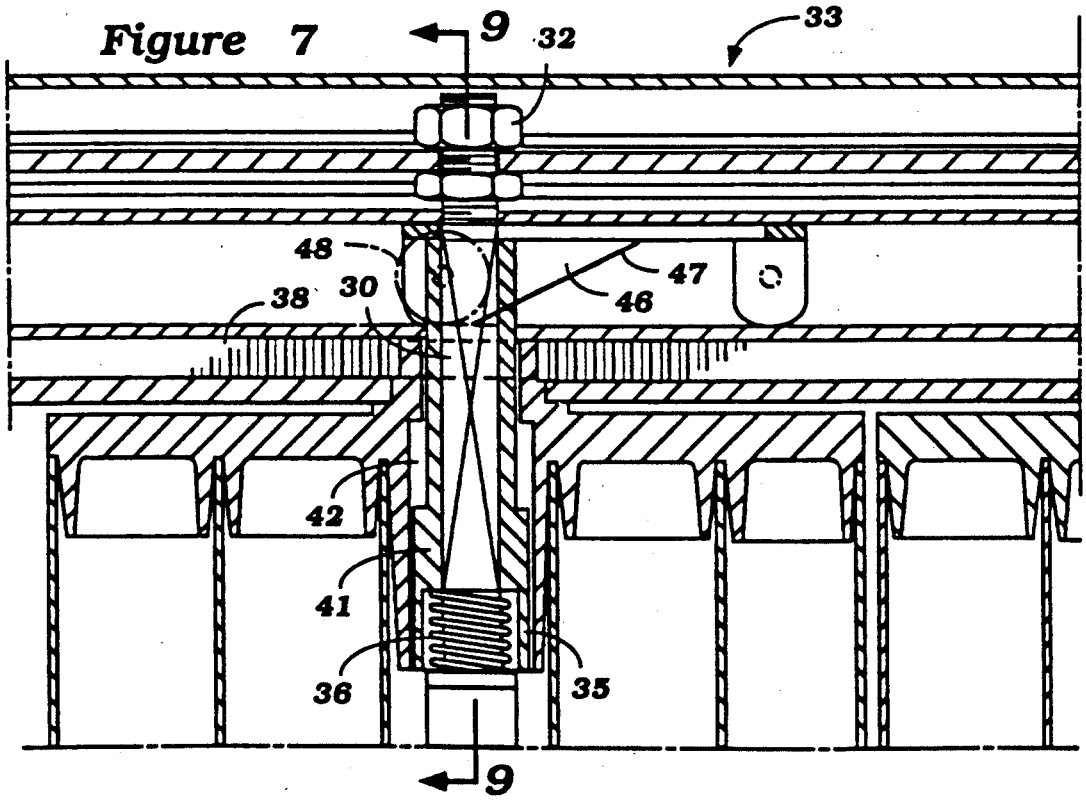
Figure 8:
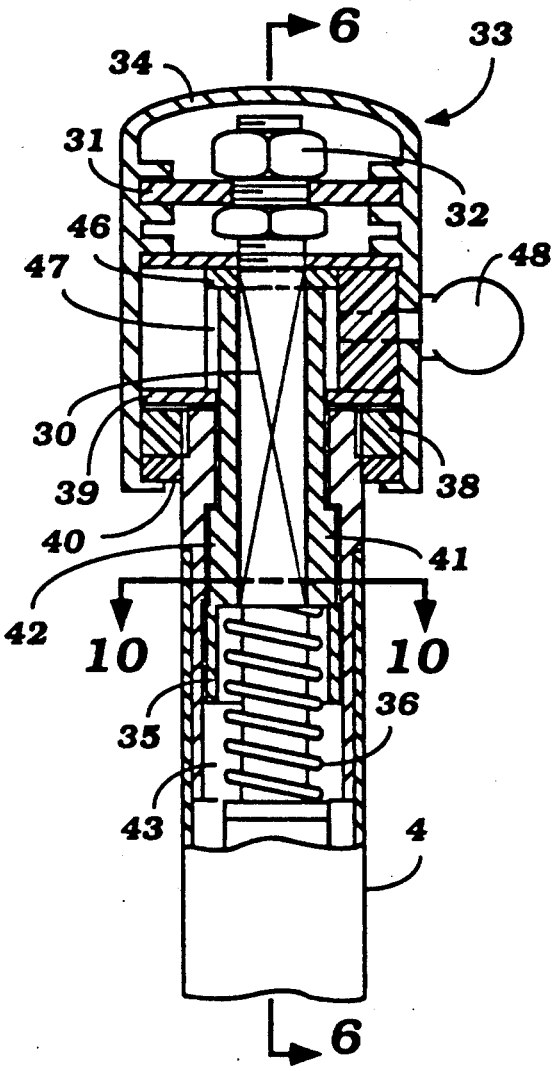
Figure 9:
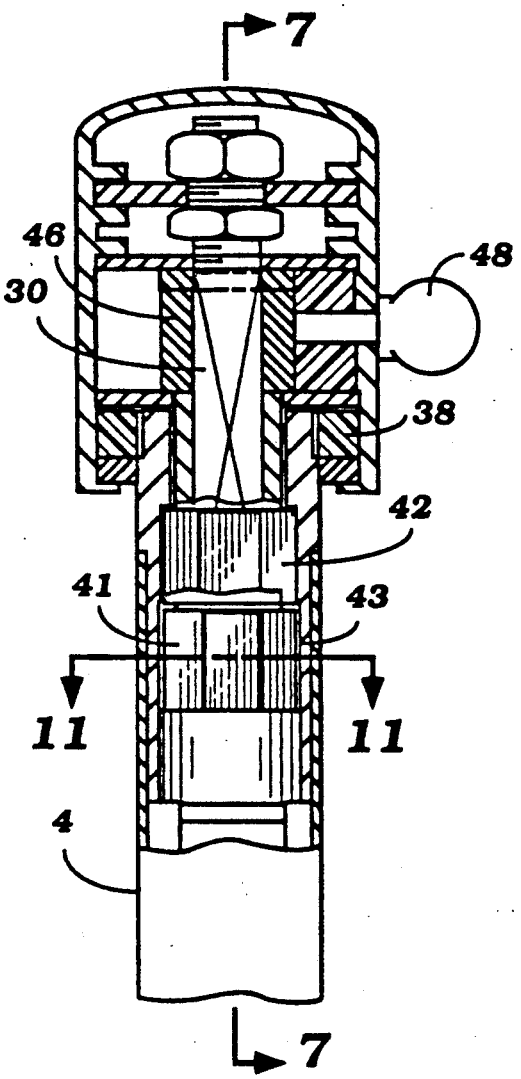
Figure 10:
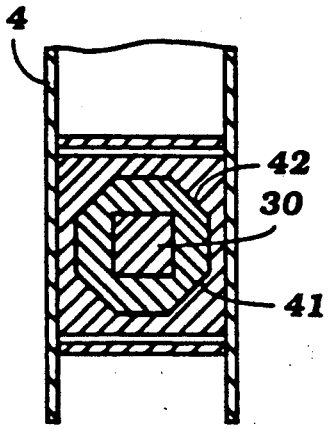
Figure 11:
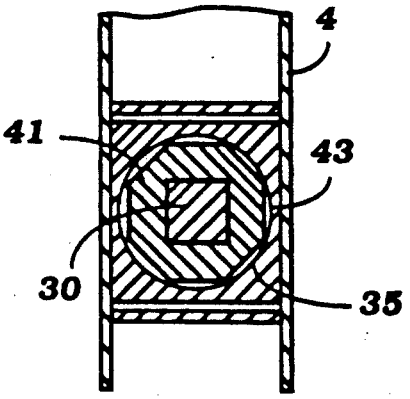

FIGS. 6–10 describe an embodiment of the slat device according to the present invention which has been developed further, such as can be used in particular in the case of a balcony. Just as in the embodiments described above, the slat device consists of a number of slat elements 4 of which only one is depicted in the figures, but which, in contrast to the above, cannot be mutually displaced. Suspension pin 30 is mounted by means of the end thereof, which is provided with a screw thread and which is passed through an opening in plate 31, on said plate 31 with nut 32. Said plate 31 forms part of the top of a balcony railing indicated by 33 and comprising a profiled component 34 which is depicted more clearly in FIGS. 8 and 9. As a result of connecting the suspension pins 30, optionally provided with the slat elements, first to plate 31 and then sliding said plate 31 into profiled component 34 a particularly simple mounting of the slat device can be achieved. The locking principle of the slat element is the same as that depicted in the previous figures. A sleeve 41 is displaceably mounted on suspension pin 30 as is evident, in particular, from FIGS. 6–9. It is also evident that the sleeve has an octagonal shape. Drilled hole 43 of nesting body 44 is of octagonal structure at the top 42 as is evident from FIG. 10 and is of a round construction at the bottom at 35, as is evident from the section of FIG. 11. Because suspension pin 30 is non rotatably connected to plate 31 and sleeve 41 is connected to suspension pin 30 only in a displaceable but otherwise nonrotatable manner, slat element 4 will not be rotatable if the octagon of the sleeve is engaged with part 42. This is depicted in FIGS. 6, 8 and 10. If a sleeve is moved downwards against the spring force of a spring 36, the engagement of the abovementioned two octagonal parts will be eliminated as is depicted in FIGS. 7, 9 and 11, as a result of which slat element 4 is able to rotate. In the case of the embodiment described here, this rotation is achieved by providing the nesting body 44 at the top with pinion teeth 37 which engage in a rack 38. At the same time, it is possible to fit a rack 38 on both sides of the pinion teeth 37. It is also possible to use a geared belt. By moving the rack(s) or geared belt in a manner known in some form or other in the prior art, the slat elements may then be moved so as to achieve the desired angular position. By moving said rack in a manner known in some form or other in the prior art, the slat elements can be moved. The latter are not connected to each other by means of cords as in the case of the preceding structures. To release the slat element, i.e. press sleeve 41 against spring 36, the following structure is used: a slide 46 can be displaced between two plates 39 and 40 fitted in the profiled balcony component 34. Said slide 46 comprises a cutout 47 which has a sloping taper. In FIG. 6 the top part of the cutout is depicted in engagement with the top part of the sleeve 41. On moving the slide to the right in FIG. 6, the top part of the sleeve 41 engages with the sloping part of the cutout 47, as a result of which said sleeve is forced downwards against the force of the spring 36 as depicted in FIGS. 7 and 9. Said movement to the right can be achieved, for example, by knob 48.

Figure 12:
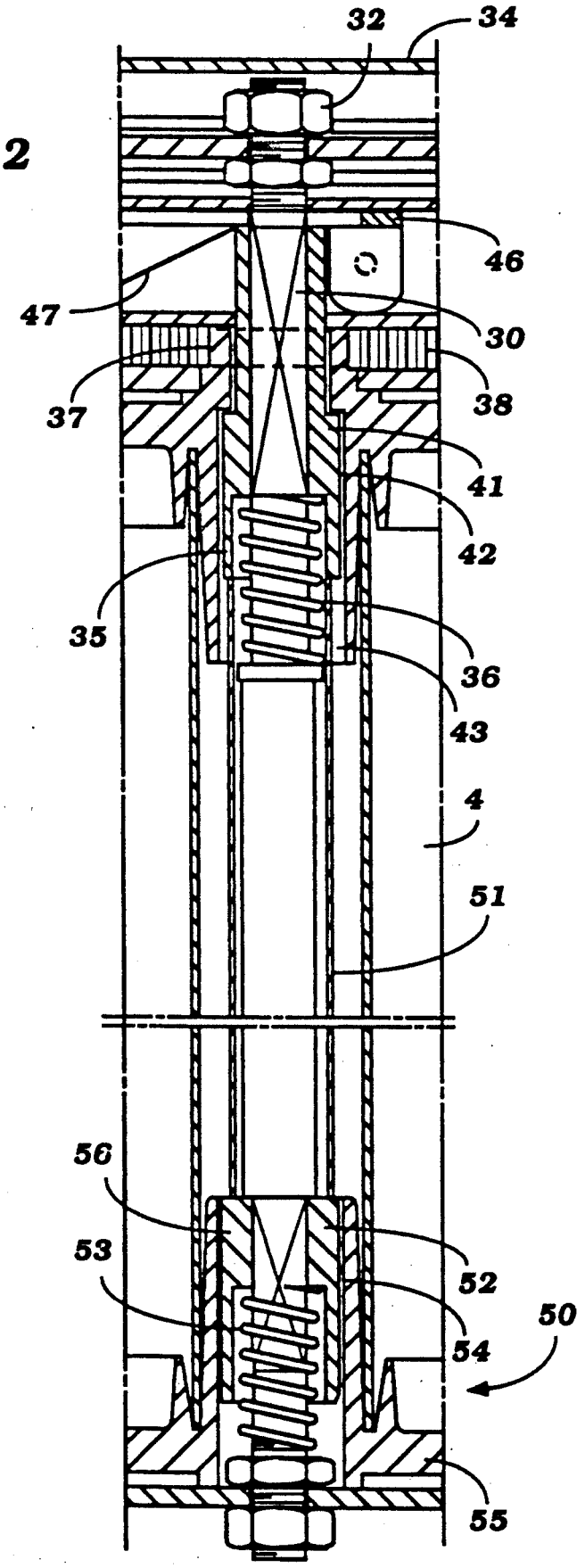
Figure 13:
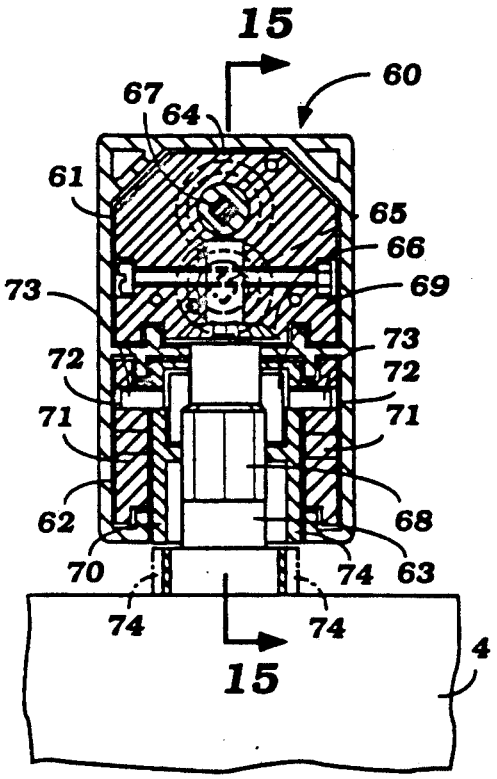
Figure 14:
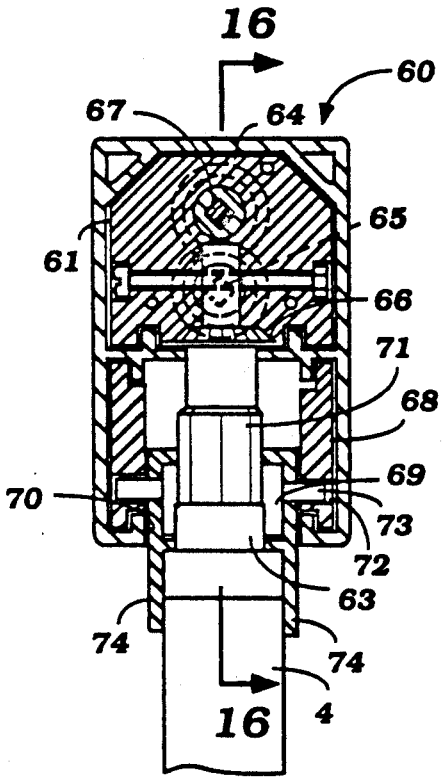
Figure 15:
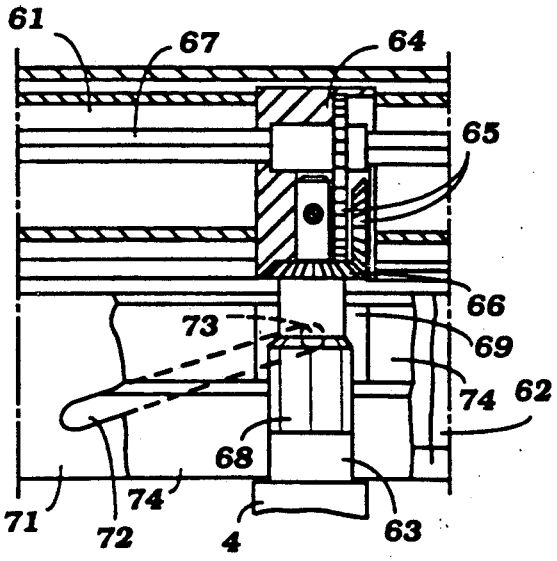
FIG. 15 shows a longitudinal section along line XV—XV in FIG. 13.
Figure 16:
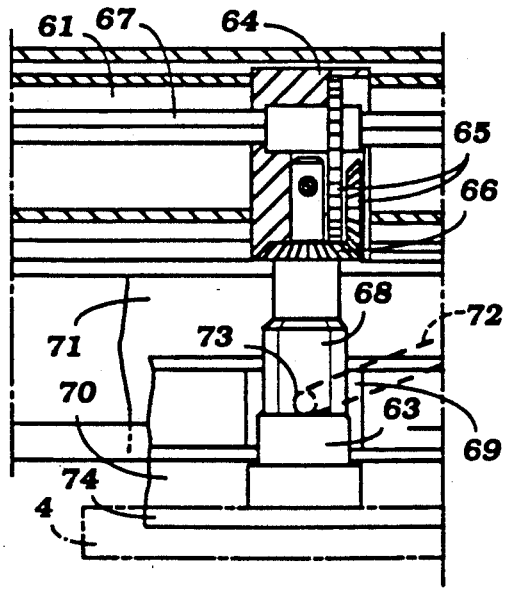
FIG. 16 shows a cross-section along line XVI—XVI in FIG. 14.

FIG. 12 depicts a device corresponding to that according to FIGS. 6–11 in which a slat element 4 is provided with an adjusting mechanism not only at the top, but an adjusting mechanism 50 is depicted also at the bottom. The use of a further adjusting mechanism 50 is to be preferred if the slat has a considerable length or is fairly slack. As a result of this it is possible to prevent in an efficient manner disadvantageous consequences due to torsion of the slat if the latter is locked at the top only. During unlocking, the bottom adjusting mechanism is moved downwards by means of a tube 51 which is operated by sleeve 41. In this process the tube 51 acts on a sleeve 52 and is driven up-wards by a spring 53. In the position depicted, the teeth 54 of the sleeve 52 are engaged in teeth 56 fitted only at the top of the nesting body 55. When the sleeve 52 is moved downwards as a result of operation with tube 51, the teeth 54 of the sleeve 52 become disengaged from the teeth 56 of the nesting body, as a result of which rotation of the slat element 4 becomes possible. Finally, FIGS. 13–16 depict an embodiment of the slat device which is provided with a safety system. In this case the supporting structure consists of a profiled component 60 which is divided into two chambers 61 and 62. Chamber 61 contains a mechanism for rotating the suspension pin 63 of the slat element 4. This consists of a gear train 64, 65 and 66 which is particularly clearly depicted in FIGS. 15 and 16, which can move in the longitudinal direction of components 60 if blocks 69 are in lifted position. By rotating spindle 67, gearwheel 66 and, consequently, suspension pin 63 and therefore slat element 4 are eventually rotated. In the bottom chamber 62 of the profiled component 60 a mechanism is depicted for releasing, and singly and doubly locking slat element 4. In this case, FIG. 13 depicts the freely rotatable position of the slat element 4 by means of continuous lines. The teeth 68 on the suspension pin 63 are, after all, not engaged in the teeth on blocks 69 which are arranged in chamber 62. Said blocks 69 can be pressed downwards in FIG. 13 to engage with teeth 68 by moving the locking body 70 downwards. The movement of the locking body 70 is controlled by a sliding body 71 which can be moved in the direction parallel to the direction of installation of a row of slats. The sliding body 70 is provided with a slot 72, and this is particularly well shown in FIGS. 15 and 16. On both sides of the locking body 70 there are disposed pins 73 which move in the slots 72. When the sliding body 71 is moved to and fro, as is evident from a comparison of FIGS. 12, 13, 14 and 15, sliding body 71 is moved downwards and as a result engagement of teeth 68 with block 69 is brought about. Sliding body 70 is provided in the figures at the bottom end thereof with forked legs 74 which have a mutual distance which corresponds to the thickness of the slat element. By moving the pins 73 partly downwards as depicted by dotted lines in FIG. 13, the forked legs will just fail to touch the slat element 4. As a result of engagement between teeth 68 and the blocks 69, however, locking is provided. If the forked legs 74 are moved further downwards, which is only possible if the slats are placed in a manner such that the forked legs can embrace them (see FIG. 14) a double locking is produced, on the one hand, between teeth 68 and the blocks 69 and, on the other hand, between the forked legs 74 and slat element 4. As a result of this a safety system is provided, in the first place because a double locking is present and in the second place because locking can only take place if the slat element is situated in the desired position. This position will usually comprise a whole row of slat elements being in line. The bottom adjusting mechanism 50 described on the basis of FIG. 12 can be used with the necessary modifications also in the embodiments depicted in FIGS. 13–16 so that the slat element is locked on two sides.

Although exemplary embodiments have been discussed above to which preference is at present given, it will be understood by those skilled in the prior art that many modifications may be made thereto without departing from the scope and the concept of the present invention. At the same time numerous combinations of the detail structures depicted in the figures are possible, while the slat elements may also be disposed horizontally.

I claim:

1. A slat device comprising: a plurality of slat elements disposed next to each other, wherein each slat element has two ends and is connected at each end to a supporting rail by a support and wherein at least one of said supports for at least one of said slat elements comprises a first member connected to the slat element and a second member connected to the supporting rail, one of said members comprising a pin having a center axis substantially parallel to the center axis of the slat element and provided with teeth and the other of said members comprising a body having a hole, the hole having a center axis substantially parallel to the center axis of the slat element to receive the pin, said hole provided with corresponding teeth, the teeth of one of said members extending only over a predetermined distance such that the slat element is moveable in a direction substantially parallel to the center axis of the slat element between a first and a second position, and when in the first position the two members of the support engage each other substantially preventing rotation of the slat elements relative to the supporting rail and when in the second position the two members of the support are out of engagement with each other substantially allowing rotation of the slat element relative to the supporting rail.

2. Slat device according to claim 1 wherein one or more slat elements of said plurality of slat elements are connected with said at least one of said slat elements having said support comprising said first and second members.

3. Slat device according to claim 2 wherein said plurality of slat elements are displaceably fitted to said supporting rail.

4. Slat device according to claim 1 wherein said pin comprises a sleeve provided with teeth and a suspension pin wherein said sleeve is non-rotatably but displaceably mounted on said suspension pin and said suspension pin is fixably attached to said slat element.

5. Slat device according to claim 4 further comprising a spring in contact with said sleeve provided to force the teeth of said sleeve into engagement with said teeth in said hole.

6. Slat device according to claim 4 further comprising a supporting structure having a sliding body provided with a sloping cutout engaging the sleeve, wherein the slat element is fitted in a non-displaceable but rotatable manner on the supporting structure.

7. Slat device according to claim 6 wherein the sleeve is non-rotatably mounted on the supporting structure and is provided with at least one forked leg which can engage the slat element.

8. Slat device according to claim 6 wherein the suspension pin is provided with a rotating drive.

9. Slat device according to claim 8 wherein the drive comprises a pinion gear wheel fitted on the suspension pin and a rack fitted in the supporting structure.

10. Slat device according to claim 8 wherein the drive comprises a gear wheel train, a gear wheel connected to the suspension pin and another gear wheel mounted on a spindle rotatably mounted on the supporting structure.

11. Slat device of claim 1 wherein both said supports for said at least one of said slat elements comprise said first and second members and wherein said supports are interconnected for combined operation.

12. A balcony railing formed from the slat device of claim 1.

* * * * *